US011348535B2

(12) United States Patent
Liao et al.

(10) Patent No.: US 11,348,535 B2
(45) Date of Patent: May 31, 2022

(54) DISPLAY CONTROL METHOD, DISPLAY CONTROL MODULE AND DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Chenghao Liao, Beijing (CN); Chungkee Cheng, Beijing (CN); Guoqiang Wu, Beijing (CN); Lei Feng, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/334,208

(22) Filed: May 28, 2021

(65) Prior Publication Data

US 2022/0068210 A1 Mar. 3, 2022

(30) Foreign Application Priority Data

Aug. 31, 2020 (CN) ..... 202010896215.1

(51) Int. Cl.
*G09G 3/3266* (2016.01)
*G09G 3/3275* (2016.01)
*G09G 3/3225* (2016.01)

(52) U.S. Cl.
CPC ..... *G09G 3/3266* (2013.01); *G09G 3/3225* (2013.01); *G09G 3/3275* (2013.01);
(Continued)

(58) Field of Classification Search
None
See application file for complete search history.

(56) References Cited

U.S. PATENT DOCUMENTS

2002/0163523 A1 11/2002 Adachi et al.
2003/0197472 A1* 10/2003 Kanauchi ..... G09G 3/3275 315/169.1
(Continued)

FOREIGN PATENT DOCUMENTS

CN 1366231 A 8/2002
CN 101615383 A 12/2009
(Continued)

OTHER PUBLICATIONS

First Office Action for Chinese Application No. 202010896215.1, dated Jan. 28, 2022, 9 Pages.

*Primary Examiner* — Christopher J Kohlman
(74) *Attorney, Agent, or Firm* — Brooks Kushman P.C.

(57) ABSTRACT

A display control method, a display control module and a display device. The display control method is applied for a display device with a display panel and a data processing circuit, and includes: according to a to-be-displayed picture, detecting, by a black-screen area detection circuit, a black-screen display area of the display panel in an always-on mode; controlling, by a logic control circuit, to stop providing display data corresponding to the black-screen display area, for the data processing circuit. The display data corresponding to the black-screen display area included in the to-be-displayed picture is black-screen display data.

15 Claims, 4 Drawing Sheets

(52) U.S. Cl.
CPC ..... *G09G 2300/0426* (2013.01); *G09G 2310/0213* (2013.01); *G09G 2330/022* (2013.01); *G09G 2330/023* (2013.01)

(56) References Cited

U.S. PATENT DOCUMENTS

| | | | |
|---|---|---|---|
| 2014/0198021 | A1 | 7/2014 | Tu et al. |
| 2016/0253955 | A1 | 9/2016 | Wu et al. |

FOREIGN PATENT DOCUMENTS

| | | | |
|---|---|---|---|
| CN | 102707524 | A | 10/2012 |
| CN | 103971647 | A | 8/2014 |
| CN | 104103240 | A | 10/2014 |
| CN | 105869587 | A | 8/2016 |
| CN | 109961736 | A | 7/2019 |

* cited by examiner

DISPLAY CONTROL METHOD, DISPLAY CONTROL MODULE AND DISPLAY DEVICE

CROSS-REFERENCE TO RELATED APPLICATION

This application claims priority to Chinese Patent Application No. 202010896215.1 filed on Aug. 31, 2020, which is incorporated herein by reference in its entirety.

TECHNICAL FIELD

The present application relates to the field of display technology, in particular to a display control method, a display control module and a display device.

BACKGROUND

Active-matrix organic light-emitting diode (AMOLED) display technology is a research focus of the new generation of display technology. Display products represented by AMOLED panels shine in the new generation of high-end smart mobile display products. In the future, AMOLED screens will be widely used with continuous development of personal smart terminals.

While AMOLED display products are favored by the market, the market puts forward more stringent requirements on characteristics of the AMOLED screens. For example, the AMOLED display products are required to have larger resolution, higher display brightness, more display functions, and longer display time. However, these display performance improvements mean that a driver integrated circuit (IC) will consume more power consumption. The high power consumption of the driver IC will not only reduce the battery life of display products such as mobile phones, but also generate more residual heat and affect the product life.

SUMMARY

According to a first aspect of the present application, a display control method for a display device with a display panel and a data processing circuit, is provided and includes: according to a to-be-displayed picture, detecting, by a black-screen area detection circuit, a black-screen display area of the display panel in an always-on mode; controlling, by a logic control circuit, to stop providing display data corresponding to the black-screen display area, for the data processing circuit. The display data corresponding to the black-screen display area included in the to-be-displayed picture is black-screen display data.

Optionally, the display control method further includes: when the display panel is in the always-on mode, controlling, by the logic control circuit, a data voltage control circuit to provide a black-screen data voltage to a data line corresponding to the black-screen display area when a row of gate line corresponding to the black-screen display area is turned on.

Optionally, the display device further includes a data driving circuit; the display control method further includes: when the display panel is in the always-on mode, controlling, by the logic control circuit, the data driving circuit to provide a data voltage for displaying to a data line corresponding to a normal display area when a row of gate line corresponding to the normal display area is turned on. The normal display area is an area included in a display area of the display panel except for the black-screen display area.

Optionally, according to the to-be-displayed picture, detecting, by the black-screen area detection circuit, the black-screen display area of the display panel in the always-on mode, includes: dividing a display area of the display panel into multiple rows and multiple columns of grid display areas; receiving, by the black-screen area detection circuit, the to-be-displayed picture, and, judging one grid display area as the black-seen display area when detecting that the to-be-displayed picture is a completely black screen in the one grid display area.

Optionally, the display device includes a gate driving circuit, M columns of pixel circuits, multiple rows of gate lines, and 2M columns of data lines, wherein M is a positive integer; a (2m−1)-th column of data line is electrically connected to pixel circuits in odd-numbered rows in an m-th column, and a 2m-th column of data line is electrically connected to pixel circuits in even-numbered rows in the m-th column, wherein m is a positive integer less than or equal to M; the display control method includes: dividing a display period into a first display time period and a second display time period in sequence; in the first display time period, controlling the gate driving circuit to sequentially scan odd-numbered rows of gate lines, and controlling the (2m−1)-th column of data line to provide a corresponding data voltage for the pixel circuits in the odd-numbered rows in the m-th column; in the second display time period, controlling the gate driving circuit to sequentially scan even-numbered rows of gate lines, and controlling the 2m-th column of data line to provide a corresponding data voltage for the pixel circuits in the even-numbered rows in the m-th column;

or, wherein the display device includes a gate driving circuit, M columns of pixel circuits, multiple rows of gate lines, and 2M columns of data lines, wherein M is a positive integer; a (2m−1)-th column of data line is electrically connected to pixel circuits in even-numbered rows in an m-th column, an 2m-th column of data line is electrically connected to pixel circuits in odd-numbered rows in the m-th column, wherein m is a positive integer less than or equal to M; the display control method includes: dividing a display period into a first display time period and a second display time period in sequence; in the first display time period, controlling the gate driving circuit to sequentially scan odd-numbered rows of gate lines, and controlling the 2m-th column of data line to provide a corresponding data voltage for the pixel circuits in the odd-numbered rows in the m-th column; in the second display time period, controlling the gate driving circuit to sequentially scan even-numbered rows of gate lines, and controlling the (2m−1)-th column of data line to provide a corresponding data voltage for the pixel circuits in the even-numbered rows in the m-th column.

Optionally, the display device includes a gate driving circuit, M columns of pixel circuits, multiple rows of gate lines, and 2M columns of data lines, wherein M is a positive integer; a (2m−1)-th column of data line is electrically connected to pixel circuits in odd-numbered rows in an m-th column, and a 2m-th column of data line is electrically connected to pixel circuits in even-numbered rows in the m-th column, wherein m is a positive integer less than or equal to M; the display control method includes: dividing a display period into a first display time period and a second display time period in sequence; in the first display time period, controlling the gate driving circuit to sequentially scan even-numbered rows of gate lines, and controlling the 2m-th column of data line to provide a corresponding data voltage for the pixel circuits in the even-numbered rows in the m-th column; in the second display time period, controlling the gate driving circuit to sequentially scan odd-numbered rows of gate lines, and controlling the (2m−1)-th column of data line to provide a corresponding data voltage for the pixel circuits in the odd-numbered rows in the m-th column;

or, wherein the display device includes a gate driving circuit, M columns of pixel circuits, multiple rows of gate lines, and 2M columns of data lines, wherein M is a positive integer; a (2m−1)-th column of data line is electrically connected to pixel circuits in even-numbered rows in an m-th column, an 2m-th column of data line is electrically connected to pixel circuits in odd-numbered rows in the m-th column, wherein m is a positive integer less than or equal to M; the display control method includes: dividing a display period into a first display time period and a second display time period in sequence; in the first display time period, controlling the gate driving circuit to sequentially scan even-numbered rows of gate lines, and controlling the (2m−1)-th column of data line to provide a corresponding data voltage for the pixel circuits in the even-numbered rows in the m-th column; in the second display time period, controlling the gate driving circuit to sequentially scan odd-numbered rows of gate lines, and controlling the 2m-th column of data line to provide a corresponding data voltage for the pixel circuits in the odd-numbered rows in the m-th column.

Optionally, the method further includes: when the display panel is in the always-on mode, in a first display time period included in a predetermined display period, controlling a frequency of a gate driving signal on an odd-numbered row of gate line to be less than or equal to a first predetermined frequency; and, in a second display time period included in the predetermined display period, controlling a frequency of a gate driving signal on an even-numbered row of gate line to be less than or equal to the first predetermined frequency; wherein the predetermined display period is a display period other than a first display period after a screen is switched.

Optionally, the method further includes: when the display panel is in the always-on mode, in a first display time period included in a first display period after a screen is switched, controlling a frequency of a gate driving signal on an odd-numbered row of gate line to be greater than or equal to a second predetermined frequency; and, in a second display time period included in the first display period after the screen is switched, controlling a frequency of a gate driving signal on an even-numbered row of gate line to be greater than or equal to the second predetermined frequency.

Optionally, the method further includes: when the display panel is in the always-on mode, in a first display time period included in a predetermined display period, controlling a frequency of a gate driving signal on an even-numbered row of gate line to be less than or equal to a first predetermined frequency; and, in a second display time period included in the predetermined display period, controlling a frequency of a gate driving signal on an odd-numbered row of gate line to be less than or equal to the first predetermined frequency; wherein the predetermined display period is a display period other than a first display period after a screen is switched.

Optionally, the method further includes: when the display panel is in the always-on mode, in a first display time period included in a first display period after a screen is switched, controlling a frequency of a gate driving signal on an even-numbered row of gate line to be greater than or equal to a second predetermined frequency; and, in a second display time period included in the first display period after the screen is switched, controlling a frequency of a gate driving signal on an odd-numbered row of gate line to be greater than or equal to the second predetermined frequency.

According to a second aspect of the present application, a display control module for a display device is provided. The display device includes a display panel, a data processing circuit and a memory storing display data corresponding to a to-be-displayed picture. The display control module includes: a black-screen area detection circuit configured to, when the display panel is in an always-on mode, detect a black-screen display area of the display panel, according to the to-be-displayed picture; and a logic control circuit configured to, when the display panel is in the always-on mode, control the memory to stop providing display data corresponding to the black-screen display area, for the data processing circuit; wherein the display data corresponding to the black-screen display area included in the to-be-displayed picture is black-screen display data.

Optionally, the display control module further includes a data voltage control circuit; the logic control circuit is further configured to, when the display panel is in the always-on mode, control the data voltage control circuit to provide a black-screen data voltage to a data line corresponding to the black-screen display area when a row of gate line corresponding to the black-screen display area is turned on.

Optionally, the display control module further includes a data driving circuit; the logic control circuit is further configured to, when the display panel is in the always-on mode, control the data driving circuit to provide a data voltage for displaying to a data line corresponding to a normal display area when a row of gate line corresponding to the normal display area is turned on; wherein the normal display area is an area included in a display area of the display panel except for the black-screen display area.

Optionally, the data driving circuit includes M data voltage output terminals, wherein M is a positive integer; the data voltage control circuit includes M first-switch-transistors and M second-switch-transistors; a control electrode of an m-th first-switch-transistor is electrically connected to the logic control circuit; a first electrode of the m-th first-switch-transistor is electrically connected to an m-th data voltage output terminal; a second electrode of the m-th first-switch-transistor is electrically connected to a black-screen data voltage terminal; the black-screen data voltage terminal is configured to provide a black-screen data voltage; a control electrode of an m-th second-switch-transistor is electrically connected to the logic control circuit; a first electrode of the m-th second-switch-transistor is electrically connected to the m-th data voltage output terminal; a second electrode of the m-th second-switch-transistor is electrically connected to a corresponding column of data line; wherein m is a positive integer less than or equal to M. The logic control circuit is configured to, according to the black-screen area and the normal display area, provide an m-th first-switch-control-signal to the control electrode of the m-th first-switch-transistor, thereby controlling the m-th first-switch-transistor to turn on and off; and provide an m-th second-switch-control-signal to the control electrode of the m-th second-switch-transistor, thereby controlling the m-th second-switch-transistor to turn on and off.

Optionally, a display area of the display panel is divided into multiple rows and multiple columns of grid display areas; the black-screen area detection circuit is configured to receive the to-be-displayed picture, and, judge one grid display area as the black-seen display area when detecting that the to-be-displayed picture is a completely black screen in the one grid display area.

Optionally, the display device includes a gate driving circuit, a data driving circuit, a multiplexing circuit, M columns of pixel circuits, multiple rows of gate lines and 2M columns of data lines, wherein M is a positive integer; a (2m−1)-th column of data line is electrically connected to pixel circuits in odd-numbered rows in an m-th column, and a 2m-th column of data line is electrically connected to pixel circuits in even-numbered rows in the m-th column, wherein m is a positive integer less than or equal to M; the data driving circuit includes M data voltage output terminals; the M data voltage output terminals are electrically connected to the 2M columns of data lines through the multiplexing circuit; an m-th data voltage output terminal provides corresponding data voltages to the (2m−1)-th column of data line and the 2m-th column of data line in a time-sharing manner; a display period is divided into a first display time period and a second display time period in sequence; the display control module further includes a scanning control circuit. The scanning control circuit is configured to, in the first display time period, control the gate driving circuit to sequentially scan odd-numbered rows of gate lines, and control the multiplexing circuit to turn on connection between the m-th data voltage output terminal and the (2m−1)-th column of data line; in the second display time period, control the gate driving circuit to sequentially scan the even-numbered rows of gate lines, and control the multiplexing circuit to turn on connection between the m-th data voltage output terminal and the 2m-th column of data line.

Optionally, the display device includes a gate driving circuit, a data driving circuit, a multiplexing circuit, M columns of pixel circuits, multiple rows of gate lines and 2M columns of data lines, wherein M is a positive integer; a (2m−1)-th column of data line is electrically connected to pixel circuits in odd-numbered rows in an m-th column, and a 2m-th column of data line is electrically connected to pixel circuits in even-numbered rows in the m-th column, wherein m is a positive integer less than or equal to M; the data driving circuit includes M data voltage output terminals; the M data voltage output terminals are electrically connected to the 2M columns of data lines through the multiplexing circuit; an m-th data voltage output terminal provides corresponding data voltages to the (2m−1)-th column of data line and the 2m-th column of data line in a time-sharing manner; a display period is divided into a first display time period and a second display time period in sequence; the display control module further includes a scanning control circuit. The scanning control circuit is configured to, in the first display time period, control the gate driving circuit to sequentially scan even-numbered rows of gate lines, and control the multiplexing circuit to turn on connection between the m-th data voltage output terminal and the 2m-th column of data line; in the second display time period, control the gate driving circuit to sequentially scan the odd-numbered rows of gate lines, and control the multiplexing circuit to turn on connection between the m-th data voltage output terminal and the (2m−1)-th column of data line.

Optionally, the display device includes a gate driving circuit, a data driving circuit, a multiplexing circuit, M columns of pixel circuits, multiple rows of gate lines and 2M columns of data lines, wherein M is a positive integer; a (2m−1)-th column of data line is electrically connected to pixel circuits in even-numbered rows in an m-th column, and a 2m-th column of data line is electrically connected to pixel circuits in odd-numbered rows in the m-th column, wherein m is a positive integer less than or equal to M; the data driving circuit includes M data voltage output terminals; the M data voltage output terminals are electrically connected to the 2M columns of data lines through the multiplexing circuit; an m-th data voltage output terminal provides corresponding data voltages to the (2m−1)-th column of data line and the 2m-th column of data line in a time-sharing manner; a display period is divided into a first display time period and a second display time period in sequence; the display control module further includes a scanning control circuit. The scanning control circuit is configured to, in the first display time period, control the gate driving circuit to sequentially scan odd-numbered rows of gate lines, and control the multiplexing circuit to turn on connection between the m-th data voltage output terminal and the 2m-th column of data line; in the second display time period, control the gate driving circuit to sequentially scan the even-numbered rows of gate lines, and control the multiplexing circuit to turn on connection between the m-th data voltage output terminal and the (2m−1)-th column of data line.

Optionally, the display device includes a gate driving circuit, a data driving circuit, a multiplexing circuit, M columns of pixel circuits, multiple rows of gate lines and 2M columns of data lines, wherein M is a positive integer; a (2m−1)-th column of data line is electrically connected to pixel circuits in even-numbered rows in an m-th column, and a 2m-th column of data line is electrically connected to pixel circuits in odd-numbered rows in the m-th column, wherein m is a positive integer less than or equal to M; the data driving circuit includes M data voltage output terminals; the M data voltage output terminals are electrically connected to the 2M columns of data lines through the multiplexing circuit; an m-th data voltage output terminal provides corresponding data voltages to the (2m−1)-th column of data line and the 2m-th column of data line in a time-sharing manner; a display period is divided into a first display time period and a second display time period in sequence; the display control module further includes a scanning control circuit. The scanning control circuit is configured to, in the first display time period, control the gate driving circuit to sequentially scan even-numbered rows of gate lines, and control the multiplexing circuit to turn on connection between the m-th data voltage output terminal and the (2m−1)-th column of data line; in the second display time period, control the gate driving circuit to sequentially scan the odd-numbered rows of gate lines, and control the multiplexing circuit to turn on connection between the m-th data voltage output terminal and the 2m-th column of data line.

According to a third aspect of the present application, a display device is provided and includes: a display panel, a memory, a data processing circuit and a display control module. The memory stores display data corresponding to a to-be-displayed picture. The display control module includes: a black-screen area detection circuit configured to, when the display panel is in an always-on mode, detect a black-screen display area of the display panel, according to the to-be-displayed picture; and a logic control circuit configured to, when the display panel is in the always-on mode, control the memory to stop providing display data corresponding to the black-screen display area, for the data processing circuit. The display data corresponding to the black-screen display area included in the to-be-displayed picture is black-screen display data.

It is to be understood that the contents in this section are not intended to identify the key or critical features of the embodiments of the present application, and are not intended to limit the scope of the present application. Other features of the present application will become readily apparent from the following description.

BRIEF DESCRIPTION OF THE DRAWINGS

The drawings are included to provide a better understanding of the application and are not to be construed as limiting the application. Wherein.

DETAILED DESCRIPTION

Reference will now be made in detail to the exemplary embodiments of the present application, examples of which are illustrated in the accompanying drawings, wherein the various details of the embodiments of the present application are included to facilitate understanding and are to be considered as exemplary only. Accordingly, a person skilled in the art should appreciate that various changes and modifications can be made to the embodiments described herein without departing from the scope and spirit of the present application. Also, descriptions of well-known functions and structures are omitted from the following description for clarity and conciseness.

Transistors employed in all the embodiments of the present application may be triodes, thin film transistors or field effect transistors or other devices with the same characteristics. In the embodiment of the present application, in order to distinguish two terminals of a transistor other than a control terminal, one terminal is referred to as a first terminal, and the other terminal is referred to as a second terminal.

In actual operation, in a case that the transistor is a triode, the control terminal may be a base electrode, the first terminal may be a collector, and the second terminal may be an emitter; or, the control terminal can be a base electrode, the first terminal may be an emitter, and the second terminal may be a collector.

In actual operation, in a case that the transistor is a thin film transistor or a field effect transistor, the control terminal may be a gate electrode, the first terminal may be a drain electrode, and the second electrode may be a source electrode; or the control terminal may be a gate electrode, the first terminal may be a source electrode, and the second electrode may be a drain electrode.

When an AMOLED display product operates in an always-on mode, most of a screen is displayed in black, and power consumption of a driver IC accounts for most of power consumption of the AMOLED display product. Since information such as clock and date on the screen is often displayed continuously for several hours or even dozens of days, it is extremely urgent to reduce the power consumption of the driver IC in this case.

In view of this, a main purpose of the present application is to provide a display control method, a display control module and a display device, which can solve the problem that display devices in the related art cannot reduce power consumption in an always-on mode.

Figure 1:
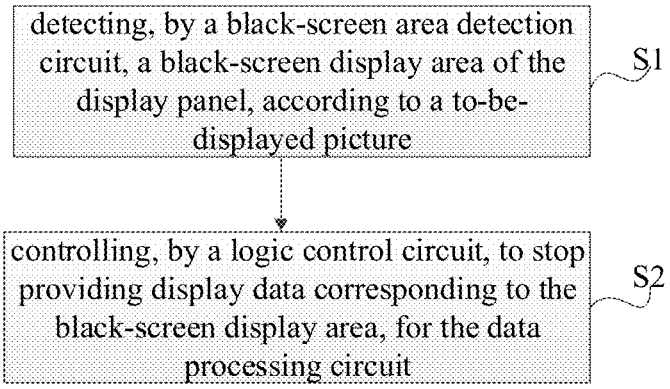
FIG. 1 is a flow chart of a display control method according to an embodiment of the present application.

A display control method according to an embodiment of the present application is applied to a display device. The display device includes a display panel and a data processing circuit. As shown in FIG. 1, the display control method includes: when the display panel is in an always-on mode, S1: detecting, by a black-screen area detection circuit, a black-screen display area of the display panel, according to a to-be-displayed picture;

S2: controlling, by a logic control circuit, to stop providing display data corresponding to the black-screen display area, for the data processing circuit;

where the display data corresponding to the black-screen display area included in the to-be-displayed picture is black-screen display data.

In the display control method according to the embodiment of the present application, in a case that the display panel is in the always-on mode, the black-screen area detection circuit detects a black-screen display area according to a to-be-displayed picture, and the logic control circuit controls to stop providing display data corresponding to the black-screen display area, for the data processing circuit, so that the data processing circuit does not process the display data corresponding to the black-screen display area, thereby reducing power consumption.

In the embodiment of the present application, a host side provides the to-be-displayed picture to the black-screen area detection circuit through a mobile industry processor interface (MIPI).

In specific implementation, the display device may further include a memory. The memory stores the to-be-displayed picture. In a case that the display panel is in the always-on mode, the logic control circuit controls the memory to stop providing display data corresponding to the black-screen display area, for the data processing circuit, which is not limited to this.

In the embodiment of the present application, the memory may be Static Random-Access Memory (SRAM) but is not limited to this.

In the embodiment of the present application, the always-on mode is also referred to as always on display (AOD) mode. In a case that the display panel is in the always-on mode, most of the display area of the display panel displays a black screen, but information such as clock and date on the display panel is often displayed continuously for several hours or even dozens of days, so power consumption of a data processing circuit accounts for most of power consumption of the display device in this case. In view of this, in the embodiment of the present application, the black-screen area detection circuit detects a black-screen display area according to a to-be-displayed picture and transmits a detection result to the logic control circuit; then the logic control circuit controls to stop providing display data corresponding to the black-screen display area, for the data processing circuit; so that the black-screen display area can display a black screen without the display data corresponding to the black-screen display area being calculated by the data processing circuit, thereby reducing power consumption.

In specific implementation, detecting, by a black-screen area detection circuit, a black-screen display area of the display panel, according to a to-be-displayed picture, includes:

dividing a display area of the display panel into multiple rows and multiple columns of grid display areas;

receiving, by the black-screen area detection circuit, the to-be-displayed picture, and, judging one grid display area as the black-seen display area when detecting that the to-be-displayed picture is a completely black screen in the one grid display area.

Figure 2:
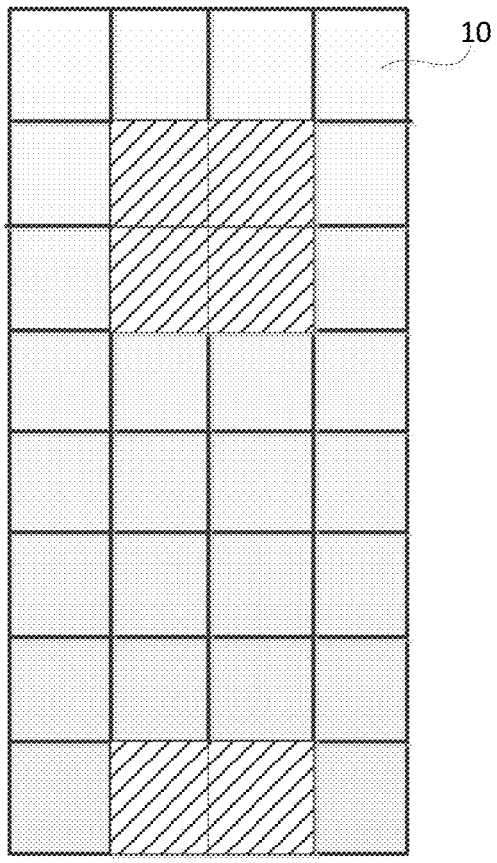
FIG. 2 is a schematic diagram of dividing a display area of a display panel into multiple rows and multiple columns of grid display areas.

As shown in FIG. 2, the display area of the display panel may be divided into multiple rows and multiple columns of grid display areas 10. For example, the display area may be divided into four rows and eight columns of grid display areas, but not limited to this.

In the embodiment shown in FIG. 2, a second-row and second-column grid display area, a second-row and third-column grid display area, a third-row and second-column grid display area, a third-row and third-column grid display area, an eight-row and second-column grid display area and an eight-row and third-column grid display area may be normal display areas, and the other grid display areas may be the black-screen display areas, but not limited to this.

In actual operation, after the black-screen area detection circuit receives the to-be-displayed picture, the black-screen area detection circuit may compare and analyze the to-be-displayed picture with a preset black-screen grid table, to judge whether the to-be-displayed picture is a completely black screen in one grid display area. When it is judged that the to-be-displayed picture is completely black screen in the one grid display area, it is judged that the one grid display area is the black-seen display area, and then the logic control circuit controls the data processing circuit to close display data corresponding to the one grid display area, thereby reducing power consumption.

In the embodiment of the present application, the black-screen area detection circuit may compare and analyze the to-be-displayed picture with a preset black-screen grid table to obtain a black block table, and then obtain the black-seen display area according to the black block table.

In specific implementation, when dividing the display area of the display panel into multiple rows and multiple columns of grid display areas, division in a horizontal direction is generally to divide into 4 slices, and division in a vertical partition may be performed according to a vertical resolution. By taking 1440×3120 as an example, division in the vertical direction may be to divide into 3120/160 to 3120/32 (i.e., 19.5 to 97.5) blocks. The data in the memory is processed in units of blocks. The black block table may also be divided into blocks according to the data in the memory.

In the embodiment of the present application, the horizontal direction may be parallel to an extension direction of gate lines, and the vertical direction may be parallel to an extension direction of data lines, which are not limited thereto.

In actual operation, a writing operation may first be performed on the memory to write display data corresponding to the to-be-displayed picture into the memory, and then a reading operation is performed on the memory to read display data corresponding to a normal display area to the data processing circuit. A time difference between the writing operation and the reading operation may be the time of turning on N rows of gate lines, where N is a positive integer, and N is the number of gate lines in a longitudinally divided block, but is not limited to this.

In the embodiment of the present application, when the display panel is in the AOD mode, the reading operation of the display data corresponding to the black-screen display area in the memory is also stopped to reduce power consumption.

In specific implementation, the data processing circuit is configured to process the display data provided by the memory to generate processed display data. In the embodiment of the present application, the display device further includes a data driving circuit, and the memory only provides the display data corresponding to the normal display area to the data processing circuit. The data processing circuit processes the display data corresponding to the normal display area to obtain the processed display data, and then the data driving circuit converts the processed display data to data voltage for displaying.

Optionally, the data processing circuit may include a display stream compression (DSC) circuit, a sub pixel rendering (SPR) circuit, a De-mura compensation circuit, a brightness control (BC) circuit, etc.

Optionally, the display control method according to the embodiment of the present application further includes:

when the display panel is in an always-on mode, controlling, by the logic control circuit, a data voltage control circuit to provide a black-screen data voltage to a data line corresponding to the black-screen display area when a corresponding row of gate line is turned on.

In optional cases, when the display panel is in an always-on mode, the logic control circuit controls the data voltage control circuit to provide a black-screen data voltage for black-screen display data, so that the display data corresponding to the black-screen display area, without being processed by the driver IC, can output a black screen, thereby ensuring that the black screen is displayed in the black-screen display area while reducing the power consumption of the display panel in the AOD mode.

Specifically, the display device may further include a data driving circuit; the display control method may further include:

when the display panel is in an always-on mode, controlling, by the logic control circuit, the data driving circuit to provide a data voltage for displaying to a data line corresponding to a normal display area when a corresponding row of gate line is turned on;

where the normal display area is an area included in the display area of the display panel except for the black-screen display area.

In specific implementation, when the display panel is in the always-on mode, the logic control circuit controls the data driving circuit to provide the data voltage for displaying to the normal display area, thereby ensuring that a corresponding picture is displayed in the normal display area.

In the embodiment of the present application, the data driving circuit and the data processing circuit may both be included in a data driver IC. According to the embodiment of the present application, the power consumption of the driver IC in the AOD mode can be reduced.

In specific implementation, in the embodiment of the present application, a display frequency can be reduced by scanning odd-numbered gate lines and even-numbered gate lines in a time-sharing manner, thereby reducing the power consumption of the display panel. That is, one column of pixel circuits of the display panel may be connected to two columns of data lines, one column of data line is electrically connected to odd-numbered rows of pixel circuits in the column of pixel circuits, and the other column of data line is connected to even-numbered rows of pixel circuits in the column of pixel circuits. A display period (which may be display time of one frame, but not limited to this) may include two display time periods in sequence. In one display time period, the odd-numbered rows of gate lines are sequentially scanned; in the other display time period, the even-numbered rows of gate lines are sequentially scanned.

In the embodiment of the present application, it is also possible to scan all rows of gate lines in sequence, not limited to time-sharing scanning of odd and even rows of gate lines.

In actual operation, when the display time of one frame includes two display time periods in sequence, in the first display time period of scanning odd-numbered rows of grid lines, a frequency of a corresponding gate drive signal is 15 Hz; in the second display period of scanning even-numbered rows of grid lines, a frequency of a corresponding gate drive signal is 15 Hz; then, in the display time of one frame, a display frequency is 30 Hz. Therefore, by scanning odd-numbered gate lines and even-numbered gate lines in a time-sharing manner, the power consumption of the display panel can be reduced.

According to a specific embodiment, the display device includes a gate driving circuit, M columns of pixel circuits, multiple rows of gate lines, and 2M columns of data lines, where M is a positive integer. A (2m−1)-th column of data line is electrically connected to pixel circuits in odd-numbered rows in an m-th column, and a 2m-th column of data line is electrically connected to pixel circuits in even-numbered rows in the m-th column, where m is a positive integer less than or equal to M.

The display control method includes:

dividing the display period into a first display time period and a second display time period in sequence;

in the first display time period, controlling the gate driving circuit to sequentially scan the odd-numbered rows of gate lines, and controlling the (2m−1)-th column of data line to provide a corresponding data voltage for pixel circuits in the odd-numbered rows in the m-th column;

in the second display time period, controlling the gate driving circuit to sequentially scan the even-numbered rows of gate lines, and controlling the 2m-th column of data line to provide a corresponding data voltage for pixel circuits in the even-numbered rows in the m-th column.

In actual operation, the display device may include M columns of pixel circuits and 2M columns of data lines. The odd-numbered column of data line is electrically connected to odd-numbered row of pixel circuits, and the even-numbered column of data line is electrically connected to the even-numbered row of pixel circuits. When scanning gate lines, the odd-numbered rows of gate lines may be sequentially scanned in the first display time period, and the even-numbered rows of gate lines may be sequentially scanned in the second display time period to reduce power consumption.

In the embodiment of the present application, when the display panel is in the AOD mode, in a case of displaying a static picture, by controlling the odd-numbered row gate driving signal and the even-numbered row gate driving signal, the picture is updated according to the odd-numbered and even-numbered rows at 15 Hz, thereby significantly reducing power consumption.

In the embodiment of the present application, when one column of pixel circuits are corresponding to two columns of data lines, an odd-numbered column of data line may be set to be electrically connected to the odd-numbered rows of pixel circuits, and an even-numbered column of data line may be set to be electrically connected to the even-numbered rows of pixel circuits. Further, when scanning the gate lines, the odd-numbered rows of gate lines are scanned first, and then the even-numbered rows of gate lines are scanned sequentially.

Optionally, the display device may further include a data driving circuit and a multiplexing circuit. The data driving circuit includes M data voltage output terminals. The M data voltage output terminals are electrically connected to the 2M columns of data lines through the multiplexing circuit. An m-th data voltage output terminal provides corresponding data voltages to the (2m−1)-th column of data line and the 2m-th column of data line in a time-sharing manner.

In the first display time period, the gate driving circuit is controlled to sequentially scan the odd-numbered rows of gate lines, and the multiplexing circuit is controlled to turn on connection between the m-th data voltage output terminal and the (2m−1)-th column of data line.

In the second display time period, the gate driving circuit is controlled to sequentially scan the even-numbered rows of gate lines, and the multiplexing circuit is controlled to turn on connection between the m-th data voltage output terminal and the 2m-th column of data line.

In specific implementation, the display device further includes a data driving circuit and a multiplexing circuit. The data driving circuit includes M data voltage output terminals. In the first display time period, the multiplexing circuit turns on connection between the m-th data voltage output terminal and the (2m−1)-th column of data line, to provide a corresponding data voltage for the odd-numbered column of data line. In the second display time period, the multiplexing circuit turns on connection between the m-th data voltage output terminal and the 2m-th column of data line, to provide a corresponding data voltage for the even-numbered column of data line.

In optional cases, when the display panel is in the always-on mode, in a first display time period included in a predetermined display period, a frequency of a gate driving signal on an odd-numbered row of gate line is controlled to be less than or equal to a first predetermined frequency; in a second display time period included in the predetermined display period, a frequency of a gate driving signal on an even-numbered row of gate line is controlled to be less than or equal to the first predetermined frequency.

The predetermined display period is a display period other than a first display period after the screen is switched.

In the embodiment of the present application, the first predetermined frequency may be 15 Hz, so that the display frequency is less than or equal to 30 Hz, but it is not limited to this.

In specific implementation, when the display panel is in the always-on mode, in a case of displaying a static picture, the display frequency is controlled to be smaller, so as to reduce power consumption while ensuring a flicker-free display.

Optionally, when the display panel is in the always-on mode, in a first display time period included in the first display period after the screen is switched, a frequency of a gate driving signal on an odd-numbered row of gate line is controlled to be greater than or equal to a second predetermined frequency. In a second display time period included in the first display period after the screen is switched, a frequency of a gate driving signal on an even-numbered row of gate line is controlled to be greater than or equal to the second predetermined frequency.

In the embodiment of the present application, the second predetermined frequency may be 30 Hz, so that the display frequency is greater than or equal to 60 Hz, but it is not limited to this.

In optional cases, when the display panel is in the always-on mode, in a case that the display screen is switched, in the first display period after the screen is switched, the display frequency is controlled to be larger to ensure that there is no flicker when the display screen is switched.

In the embodiment of the present application, the display period may be the display time of one frame, the predetermined display period may be the display time of a predetermined frame, and the first display period after the screen is switched may be the first frame display time the after the screen is switched, which are not limited thereto.

Figure 3:
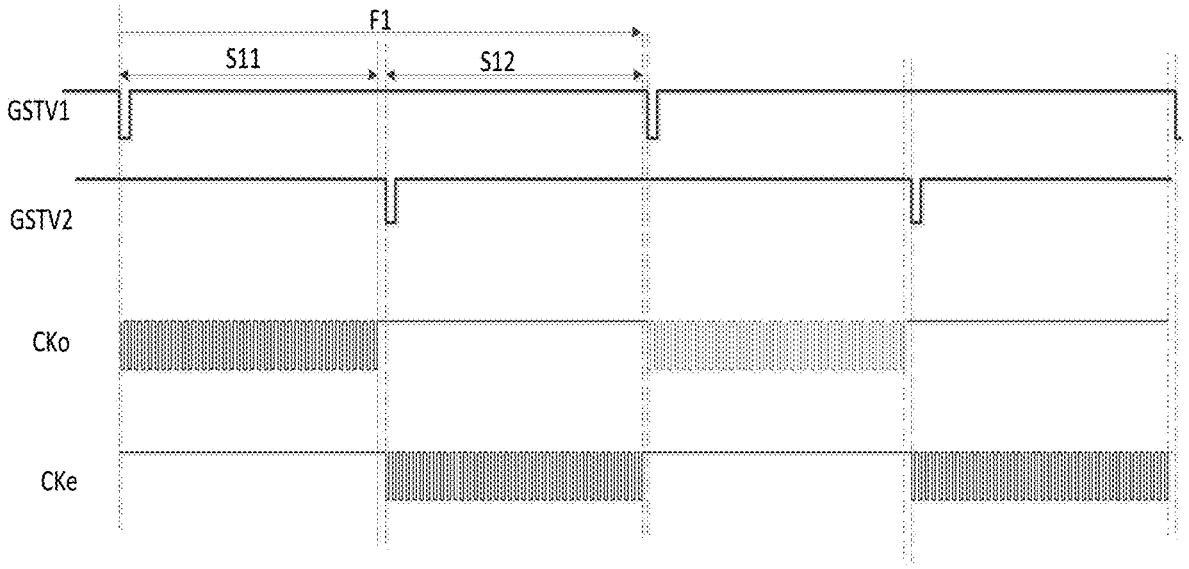
FIG. 3 is a waveform diagram of various clock signals in a first display time period S11 and a second display time period S12 included in a first frame display time F1.

As shown in FIG. 3, the first frame display time F1 may include a first display time period S11 and a second display time period S12 that are sequentially set.

In the first display time period S11, odd-numbered rows of gate lines are sequentially scanned.

In the second display time period S12, even-numbered rows of gate lines are sequentially scanned.

The display device may include a first gate driving circuit and a second gate driving circuit. The first gate driving circuit is configured to provide an odd-row gate driving signal for an odd-numbered row of gate line. The second gate driving circuit is configured to provide an even-row gate driving signal for an even-numbered row of gate line. In FIG. 3, GVST1 represents a first start signal provided for the first gate driving circuit, and GVST2 represents a second start signal provided for the second gate driving circuit.

In FIG. 3, CKo represents a clock signal provided for the first gate driving circuit, and CKe represents a clock signal provided for the second gate driving circuit.

It is assumed that a display screen is switched from a first display screen to a second display screen after the first frame display time is over, then, in a first display time period included in second frame display time, a frequency of CKo may be larger. In a second display time period included in the second frame display time, a frequency of CKe may be larger.

In the first display time period included in second frame display time, the frequency of CKo is greater than the frequency of CKo in the first display time period S11. In the second display time period included in the second frame display time, the frequency of CKe is greater than the CKe in the second display time period S12.

In a first display time period included in a third frame display time, the frequency of CKo is restored to a smaller frequency. In a second display time period included in the third frame display time, the frequency of CKe is restored to a smaller frequency.

According to another specific embodiment, the display device includes a gate driving circuit, M columns of pixel circuits, multiple rows of gate lines, and 2M columns of data lines, where M is a positive integer. The (2m−1)-th column of data line is electrically connected to pixel circuits in odd-numbered rows in the m-th column. The 2m-th column of data line is electrically connected to pixel circuits in even-numbered rows in the m-th column, where m is a positive integer less than or equal to M.

The display control method includes:

dividing the display period into a first display time period and a second display time period in sequence;

in the first display time period, controlling the gate driving circuit to sequentially scan the even-numbered rows of gate lines, and controlling the 2m-th column of data line to provide a corresponding data voltage for pixel circuits in the even-numbered rows in the m-th column;

in the second display time period, controlling the gate driving circuit to sequentially scan the odd-numbered rows of gate lines, and controlling the (2m−1)-th column of data line to provide a corresponding data voltage for pixel circuits in the odd-numbered rows in the m-th column.

In actual operation, the display device may include M columns of pixel circuits and 2M columns of data lines. The odd-numbered column of data line is electrically connected to odd-numbered row of pixel circuits, and the even-numbered column of data line is electrically connected to the even-numbered row of pixel circuits. When scanning gate lines, the even-numbered rows of gate lines may be sequentially scanned in the first display time period, and the odd-numbered rows of gate lines may be sequentially scanned in the second display time period to reduce power consumption.

In the embodiment of the present application, when one column of pixel circuits are corresponding to two columns of data lines, an odd-numbered column of data line may be set to be electrically connected to the odd-numbered rows of pixel circuits, and an even-numbered column of data line may be set to be electrically connected to the even-numbered rows of pixel circuits. Further, when scanning the gate lines, the even-numbered rows of gate lines are scanned first, and then the odd-numbered rows of gate lines are scanned sequentially.

Optionally, the display device may further include a data driving circuit and a multiplexing circuit. The data driving circuit includes M data voltage output terminals. The M data voltage output terminals are electrically connected to the 2M columns of data lines through the multiplexing circuit. An m-th data voltage output terminal provides corresponding data voltages to the (2m−1)-th column of data line and the 2m-th column of data line in a time-sharing manner.

In the first display time period, the gate driving circuit is controlled to sequentially scan the even-numbered rows of gate lines, and the multiplexing circuit is controlled to turn on connection between the m-th data voltage output terminal and the 2m-th column of data line.

In the second display time period, the gate driving circuit is controlled to sequentially scan the odd-numbered rows of gate lines, and the multiplexing circuit is controlled to turn on connection between the m-th data voltage output terminal and the (2m−1)-th column of data line.

In specific implementation, the display device further includes a data driving circuit and a multiplexing circuit. The data driving circuit includes M data voltage output terminals. In the first display time period, the multiplexing circuit turns on connection between the m-th data voltage output terminal and the 2m-th column of data line, to provide a corresponding data voltage for the even-numbered column of data line. In the second display time period, the multiplexing circuit turns on connection between the m-th data voltage output terminal and the (2m−1)-th column of data line, to provide a corresponding data voltage for the odd-numbered column of data line.

In optional cases, when the display panel is in the always-on mode, in a first display time period included in a predetermined display period, a frequency of a gate driving signal on an even-numbered row of gate line is controlled to be less than or equal to a first predetermined frequency; in a second display time period included in the predetermined display period, a frequency of a gate driving signal on an odd-numbered row of gate line is controlled to be less than or equal to the first predetermined frequency.

The predetermined display period is a display period other than a first display period after the screen is switched.

In specific implementation, when the display panel is in the always-on mode, in a case of displaying a static picture, the display frequency is controlled to be smaller, so as to reduce power consumption while ensuring a flicker-free display.

Optionally, when the display panel is in the always-on mode, in a first display time period included in the first display period after the screen is switched, a frequency of a gate driving signal on an even-numbered row of gate line is controlled to be greater than or equal to a second predetermined frequency. In a second display time period included in the first display period after the screen is switched, a frequency of a gate driving signal on an odd-numbered row of gate line is controlled to be greater than or equal to the second predetermined frequency.

In optional cases, when the display panel is in the always-on mode, in a case that the display screen is switched, in the first display period after the screen is switched, the display frequency is controlled to be larger to ensure that there is no flicker when the display screen is switched.

According to another specific embodiment, the display device includes a gate driving circuit, M columns of pixel circuits, multiple rows of gate lines, and 2M columns of data lines, where M is a positive integer. The (2m−1)-th column of data line is electrically connected to pixel circuits in even-numbered rows in the m-th column. The 2m-th column of data line is electrically connected to pixel circuits in odd-numbered rows in the m-th column, where m is a positive integer less than or equal to M.

The display control method includes:

dividing the display period into a first display time period and a second display time period in sequence;

in the first display time period, controlling the gate driving circuit to sequentially scan the odd-numbered rows of gate lines, and controlling the 2m-th column of data line to provide a corresponding data voltage for pixel circuits in the odd-numbered rows in the m-th column;

in the second display time period, controlling the gate driving circuit to sequentially scan the even-numbered rows of gate lines, and controlling the (2m−1)-th column of data line to provide a corresponding data voltage for pixel circuits in the even-numbered rows in the m-th column.

In actual operation, the display device may include M columns of pixel circuits and 2M columns of data lines. The odd-numbered column of data line is electrically connected to even-numbered row of pixel circuits, and the even-numbered column of data line is electrically connected to the odd-numbered row of pixel circuits. When scanning gate lines, the odd-numbered rows of gate lines may be sequentially scanned in the first display time period, and the even-numbered rows of gate lines may be sequentially scanned in the second display time period to reduce power consumption of the driver IC.

In the embodiment of the present application, when one column of pixel circuits are corresponding to two columns of data lines, an odd-numbered column of data line may be set to be electrically connected to the even-numbered rows of pixel circuits, and an even-numbered column of data line may be set to be electrically connected to the odd-numbered rows of pixel circuits. Further, when scanning the gate lines, the odd-numbered rows of gate lines are scanned first, and then the even-numbered rows of gate lines are scanned sequentially.

Optionally, the display device may further include a data driving circuit and a multiplexing circuit. The data driving circuit includes M data voltage output terminals. The M data voltage output terminals are electrically connected to the 2M columns of data lines through the multiplexing circuit. An m-th data voltage output terminal provides corresponding data voltages to the (2m−1)-th column of data line and the 2m-th column of data line in a time-sharing manner.

In the first display time period, the gate driving circuit is controlled to sequentially scan the odd-numbered rows of gate lines, and the multiplexing circuit is controlled to turn on connection between the m-th data voltage output terminal and the 2m-th column of data line.

In the second display time period, the gate driving circuit is controlled to sequentially scan the even-numbered rows of gate lines, and the multiplexing circuit is controlled to turn on connection between the m-th data voltage output terminal and the (2m−1)-th column of data line.

In specific implementation, the display device further includes a data driving circuit and a multiplexing circuit. The data driving circuit includes M data voltage output terminals. In the first display time period, the multiplexing circuit turns on connection between the m-th data voltage output terminal and the 2m-th column of data line, to provide a corresponding data voltage for the even-numbered column of data line. In the second display time period, the multiplexing circuit turns on connection between the m-th data voltage output terminal and the (2m−1)-th column of data line, to provide a corresponding data voltage for the odd-numbered column of data line.

In optional cases, when the display panel is in the always-on mode, in a first display time period included in a predetermined display period, a frequency of a gate driving signal on an odd-numbered row of gate line is controlled to be less than or equal to a first predetermined frequency; in a second display time period included in the predetermined display period, a frequency of a gate driving signal on an even-numbered row of gate line is controlled to be less than or equal to the first predetermined frequency.

The predetermined display period is a display period other than a first display period after the screen is switched.

In specific implementation, when the display panel is in the always-on mode, in a case of displaying a static picture, the display frequency is controlled to be smaller, so as to reduce power consumption while ensuring a flicker-free display.

Optionally, when the display panel is in the always-on mode, in a first display time period included in the first display period after the screen is switched, a frequency of a gate driving signal on an odd-numbered row of gate line is controlled to be greater than or equal to a second predetermined frequency. In a second display time period included in the first display period after the screen is switched, a frequency of a gate driving signal on an even-numbered row of gate line is controlled to be greater than or equal to the second predetermined frequency.

In optional cases, when the display panel is in the always-on mode, in a case that the display screen is switched, in the first display period after the screen is switched, the display frequency is controlled to be larger to ensure that there is no flicker when the display screen is switched.

According to another specific embodiment, the display device includes a gate driving circuit, M columns of pixel circuits, multiple rows of gate lines, and 2M columns of data lines, where M is a positive integer. The (2m−1)-th column of data line is electrically connected to pixel circuits in even-numbered rows in the m-th column. The 2m-th column of data line is electrically connected to pixel circuits in odd-numbered rows in the m-th column, where m is a positive integer less than or equal to M.

The display control method includes:

dividing the display period into a first display time period and a second display time period in sequence;

in the first display time period, controlling the gate driving circuit to sequentially scan the even-numbered rows of gate lines, and controlling the (2m−1)-th column of data line to provide a corresponding data voltage for pixel circuits in the even-numbered rows in the m-th column;

in the second display time period, controlling the gate driving circuit to sequentially scan the odd-numbered rows of gate lines, and controlling the 2m-th column of data line to provide a corresponding data voltage for pixel circuits in the odd-numbered rows in the m-th column.

In actual operation, the display device may include M columns of pixel circuits and 2M columns of data lines. The odd-numbered column of data line is electrically connected to even-numbered row of pixel circuits, and the even-numbered column of data line is electrically connected to the odd-numbered row of pixel circuits. When scanning gate lines, the even-numbered rows of gate lines may be sequentially scanned in the first display time period, and the odd-numbered rows of gate lines may be sequentially scanned in the second display time period to reduce power consumption of the driver IC.

In the embodiment of the present application, when one column of pixel circuits are corresponding to two columns of data lines, an even-numbered column of data line may be set to be electrically connected to the odd-numbered rows of pixel circuits, and an odd-numbered column of data line may be set to be electrically connected to the even-numbered rows of pixel circuits. Further, when scanning the gate lines, the even-numbered rows of gate lines are scanned first, and then the odd-numbered rows of gate lines are scanned sequentially.

Optionally, the display device may further include a data driving circuit and a multiplexing circuit. The data driving circuit includes M data voltage output terminals. The M data voltage output terminals are electrically connected to the 2M columns of data lines through the multiplexing circuit. An m-th data voltage output terminal provides corresponding data voltages to the (2m−1)-th column of data line and the 2m-th column of data line in a time-sharing manner.

In the first display time period, the gate driving circuit is controlled to sequentially scan the even-numbered rows of gate lines, and the multiplexing circuit is controlled to turn on connection between the m-th data voltage output terminal and the (2m−1)-th column of data line.

In the second display time period, the gate driving circuit is controlled to sequentially scan the odd-numbered rows of gate lines, and the multiplexing circuit is controlled to turn on connection between the m-th data voltage output terminal and the 2m-th column of data line.

In specific implementation, the display device further includes a data driving circuit and a multiplexing circuit. The data driving circuit includes M data voltage output terminals. In the first display time period, the multiplexing circuit turns on connection between the m-th data voltage output terminal and the (2m−1)-th column of data line, to provide a corresponding data voltage for the odd-numbered column of data line. In the second display time period, the multiplexing circuit turns on connection between the m-th data voltage output terminal and the 2m-th column of data line, to provide a corresponding data voltage for the even-numbered column of data line.

In optional cases, when the display panel is in the always-on mode, in a first display time period included in a predetermined display period, a frequency of a gate driving signal on an even-numbered row of gate line is controlled to be less than or equal to a first predetermined frequency; in a second display time period included in the predetermined display period, a frequency of a gate driving signal on an odd-numbered row of gate line is controlled to be less than or equal to the first predetermined frequency.

The predetermined display period is a display period other than a first display period after the screen is switched.

In specific implementation, when the display panel is in the always-on mode, in a case of displaying a static picture, the display frequency is controlled to be smaller, so as to reduce power consumption while ensuring a flicker-free display.

Optionally, when the display panel is in the always-on mode, in a first display time period included in the first display period after the screen is switched, a frequency of a gate driving signal on an even-numbered row of gate line is controlled to be greater than or equal to a second predetermined frequency. In a second display time period included in the first display period after the screen is switched, a frequency of a gate driving signal on an odd-numbered row of gate line is controlled to be greater than or equal to the second predetermined frequency.

In optional cases, when the display panel is in the always-on mode, in a case that the display screen is switched, in the first display period after the screen is switched, the display frequency is controlled to be larger to ensure that there is no flicker when the display screen is switched.

Figure 4:
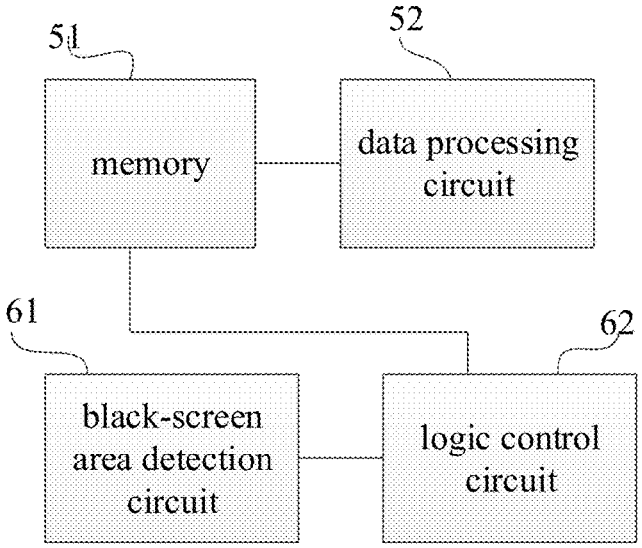
FIG. 4 is a schematic structural diagram of a display control module according to an embodiment of the present application.

A display control module according to the embodiment of the present application may be applied to a display device. As shown in FIG. 4, the display device includes a display panel, a memory 51 and a data processing circuit 52. The memory 51 stores display data corresponding to a to-be-displayed pictures. The display control module includes a black-screen area detection circuit 61 and a logic control circuit 62.

The memory 51 is electrically connected to the data processing circuit 52.

The black-screen area detection circuit 61 is configured to, when the display panel is in an always-on mode, detect a black-screen display area of the display panel, according to a to-be-displayed picture.

The logic control circuit 62 is electrically connected to the black-screen area detection circuit 61 and the memory 51, respectively. The logic control circuit 62 is configured to, when the display panel is in an always-on mode, control the memory 51 to stop providing display data corresponding to the black-screen display area, for the data processing circuit 52.

The display data corresponding to the black-screen display area included in the to-be-displayed picture is black-screen display data.

When the display control module according to the embodiment of the present application is in operation, in a case that the display panel is in the always-on mode, the black-screen area detection circuit 61 detects a black-screen display area according to a to-be-displayed picture, and the logic control circuit controls the memory 51 to stop providing display data corresponding to the black-screen display area, for the data processing circuit 52, so that the data processing circuit 52 does not process the display data corresponding to the black-screen display area, thereby reducing power consumption.

In specific implementation, the display area of the display panel is divided into multiple rows and multiple columns of grid display areas. The black-screen area detection circuit is configured to receive the to-be-displayed picture, and, judge one grid display area as the black-seen display area when detecting that the to-be-displayed picture is a completely black screen in the one grid display area.

In actual operation, after the black-screen area detection circuit receives the to-be-displayed picture, the black-screen area detection circuit may compare and analyze the to-be-displayed picture with a preset black-screen grid table, to judge whether the to-be-displayed picture is a completely black screen in one grid display area. When it is judged that the to-be-displayed picture is completely black screen in the one grid display area, it is judged that the one grid display area is the black-seen display area, and then the logic control circuit controls the data processing circuit to close display data corresponding to the one grid display area, thereby reducing power consumption.

Figure 5:
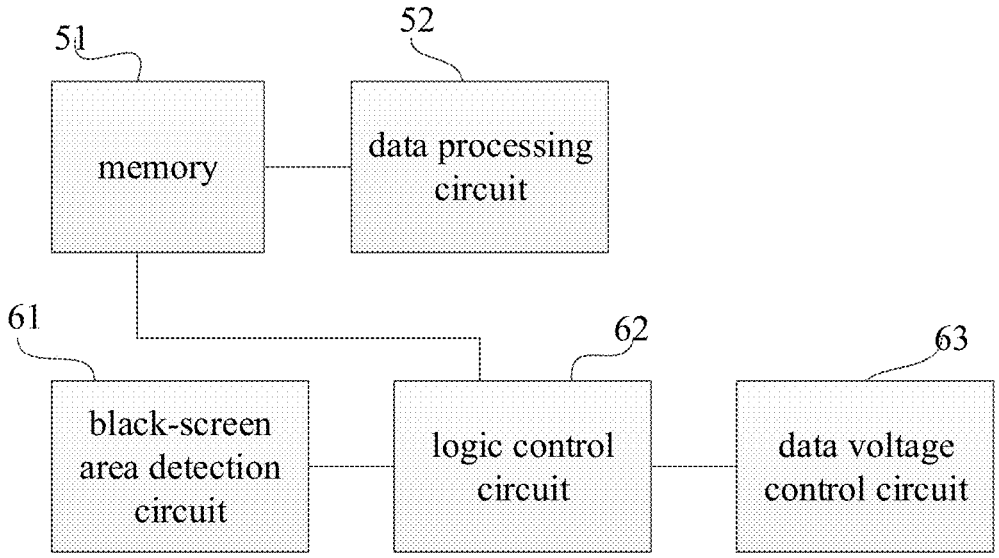
FIG. 5 is a schematic structural diagram of a display control module according to another embodiment of the present application.

In one embodiment of the present application, as shown in FIG. 5, based on the embodiment of the display control module shown in FIG. 4, the display control module further includes a data voltage control circuit 63.

The logic control circuit 62 is further electrically connected to the data voltage control circuit 63. The logic control circuit 62 is further configured to, when the display panel is in an always-on mode, control the data voltage control circuit 63 to provide a black-screen data voltage to a data line corresponding to the black-screen display area when a corresponding row of gate line is turned on.

In specific implementation, when the display panel is in an always-on mode, the data voltage control circuit 63 is controlled to provide a black-screen data voltage to a data line corresponding to the black-screen display area when a corresponding row of gate line is turned on, so that the display data corresponding to the black-screen display area, without being processed by the driver IC, can output a black screen, thereby ensuring that the black screen is displayed in the black-screen display area while reducing the power consumption of the display panel in the AOD mode.

In specific implementation, the display device further includes a data driving circuit.

The logic control circuit is further configured to, when the display panel is in an always-on mode, control the data driving circuit to provide a data voltage for displaying to a data line corresponding to a normal display area when a corresponding row of gate line is turned on;

where the normal display area is an area included in the display area of the display panel except for the black-screen display area.

In actual operation, the data driving circuit provides data voltages for displaying to the normal display area.

Figure 6:
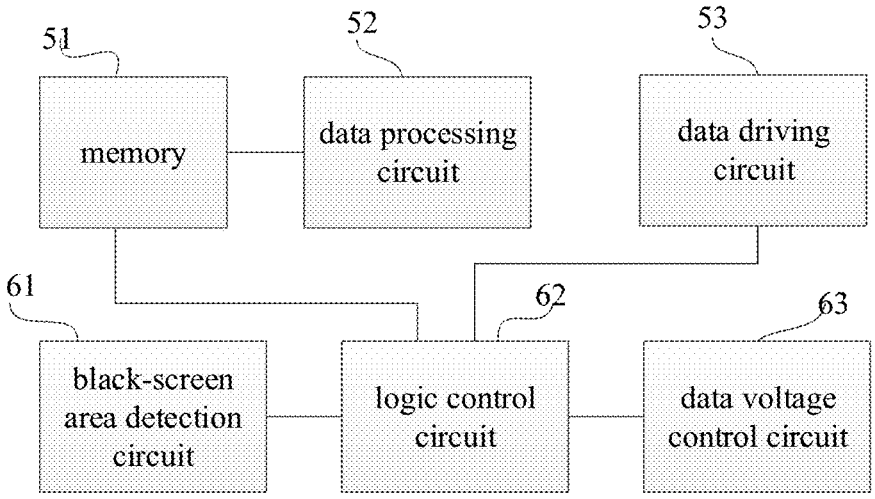
FIG. 6 is a schematic structural diagram of a display control module according to another embodiment of the present application.

As shown in FIG. 6, based on the embodiment of the display control module shown in FIG. 5, the display device further includes a data driving circuit 53.

The logic control circuit 62 is further electrically connected to the data drive circuit 53. The logic control circuit 62 is further configured to, when the display panel is in the always-on mode, control the data driving circuit 53 to provide a data voltage for displaying to a data line corresponding to a normal display area when a corresponding row of gate line is turned on;

where the normal display area is an area included in the display area of the display panel except for the black-screen display area.

In a specific implementation, the display device further includes a data driving circuit 53. As shown in FIG. 6, the data driving circuit 53 is further electrically connected to the data processing circuit 52. The memory 51 only provides the display data corresponding to the normal display area to the data processing circuit 52. The data processing circuit 52 processes the display data corresponding to the normal display area to obtain the processed display data, and transmits the processed display data to the data driving circuit 53. Then, the data driving circuit 53 converts the processed display data to data voltage for displaying.

Optionally, the data driving circuit includes M data voltage output terminals, where M is a positive integer.

The data voltage control circuit includes M first-switch-transistors and M second-switch-transistors.

A control electrode of an m-th first-switch-transistor is electrically connected to the logic control circuit. A first electrode of the m-th first-switch-transistor is electrically connected to an m-th data voltage output terminal. A second electrode of the m-th first-switch-transistor is electrically connected to a black-screen data voltage terminal. The black-screen data voltage terminal is used to provide a black-screen data voltage.

A control electrode of an m-th second-switch-transistor is electrically connected to the logic control circuit. A first electrode of the m-th second-switch-transistor is electrically connected to the m-th data voltage output terminal. A second electrode of the m-th second-switch-transistor is electrically connected to a corresponding column of data line;

Where m is a positive integer less than or equal to M.

The logic control circuit is configured to, according to the black-screen area and the normal display area, provide an m-th first-switch-control-signal to the control electrode of the m-th first-switch-transistor, thereby controlling the m-th first-switch-transistor to turn on and off; and provide an m-th second-switch-control-signal to the control electrode of the m-th second-switch-transistor, thereby controlling the m-th second-switch-transistor to turn on and off.

In the embodiment of the present application, the black-screen data voltage terminal may be a high voltage terminal. The high voltage terminal is used to provide a high voltage AVDD, but is not limited to this.

Figure 7:
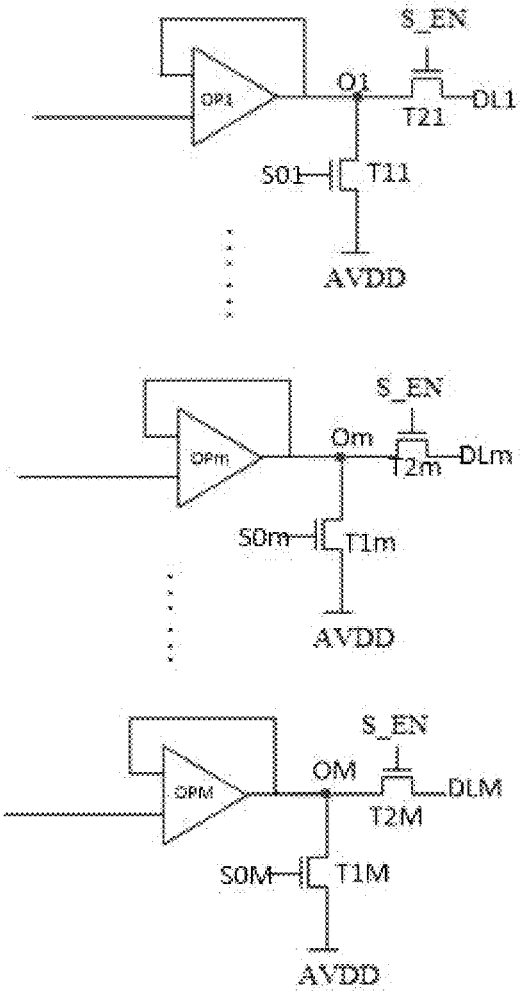
FIG. 7 is a circuit diagram of a data voltage control circuit in a display control module according to an embodiment of the present application.

As shown in FIG. 7, the data driving circuit includes M data voltage output terminals.

In FIG. 7, the reference number O1 represents a first data voltage output terminal included in the data driving circuit; the reference number Om represents an m-th data voltage output terminal included in the data driving circuit; the reference number OM represents an M-th data voltage output terminal included in the data driving circuit.

In FIG. 7, the reference number T11 represents a first first-switch-transistor; the reference number T21 represents a first second-switch-transistor; the reference number T1*m* represents an m-th first-switch-transistor; the reference number T2*m* represents an m-th second-switch-transistor; the reference number T1M represents an M-th first-switch-transistor; the reference number T2M represents an M-th second-switch-transistor.

A gate electrode of the first first-switch-transistor T11 is electrically connected to a first switch control signal output terminal S01 of the logic control circuit. A source electrode of the first first-switch-transistor T11 is electrically connected to a source electrode of the first second-switch-transistor T21. A drain electrode of the first first-switch-transistor T11 is electrically connected to the high voltage terminal. The high voltage terminal is used to provide a high voltage AVDD. A gate electrode of the first second-switch-transistor T21 is electrically connected to a data writing control terminal S_EN of the logic control circuit. A drain electrode of the first second-switch-transistor T21 is electrically connected to a first column of data line DL1.

A gate electrode of the m-th first-switch-transistor T1*m* is electrically connected to an m-th switch control signal output terminal S0*m* of the logic control circuit. A source electrode of the m-th first-switch-transistor T1*m* is electrically connected to a source electrode of the m-th second-switch-transistor T2*m*. A drain electrode of the m-th first-switch-transistor T1*m* is electrically connected to the high voltage terminal. A gate electrode of the m-th second-switch-transistor T2*m* is electrically connected to the data writing control terminal S_EN of the logic control circuit. A drain electrode of the m-th second-switch-transistor T2*m* is electrically connected to an m-th column of data line DLm.

A gate electrode of the M-th first-switch-transistor T1M is electrically connected to an M-th switch control signal output terminal S0M of the logic control circuit. A source electrode of the M-th first-switch-transistor T1M is electrically connected to a source electrode of the M-th second-switch-transistor T2M. A drain electrode of the M-th first-switch-transistor T1M is electrically connected to the high voltage terminal. A gate electrode of the M-th second-switch-transistor T2M is electrically connected to the data writing control terminal S_EN of the logic control circuit. A drain electrode of the M-th second-switch-transistor T2M is electrically connected to an M-th column of data line DLM.

In the embodiment of the data driving circuit shown in FIG. 7, each transistor may be an n-type thin film transistor, which is not limited thereto.

In the embodiment of the data driving circuit shown in FIG. 7, the black-screen data voltage terminal is the high voltage terminal.

When the embodiment of the data driving circuit shown in FIG. 7 is in operation, in a case that each first switch transistor is turned on, AVDD is provided to a corresponding column of data line; in a case that each first switch transistor is turned off, a data voltage for displaying, which is provided by the data voltage output terminal corresponding to one column of data line, is provided to the corresponding one column of data line.

In the embodiment of the data driving circuit shown in FIG. 7, the reference number OP1 represents a first operational amplifier; the reference number OPm represents an m-th operational amplifier; the reference number OPM represents an M-th operational amplifier.

Figure 8:
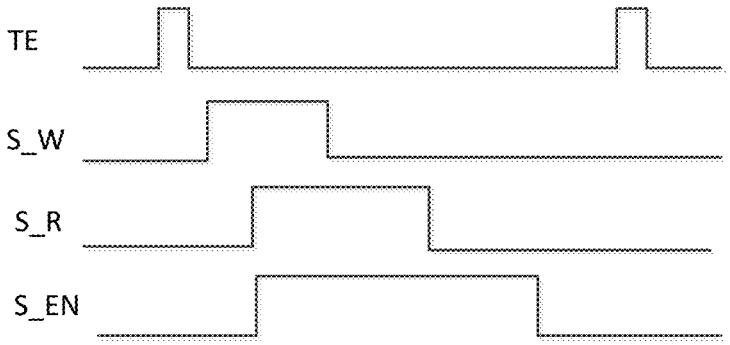
FIG. 8 is an operation timing diagram of the data voltage control circuit shown in FIG. 7.

As shown in FIG. 8, when the embodiment of the data driving circuit shown in FIG. 7 is in operation, a write signal S_W to the memory is a high voltage signal, and then a read signal S_R to the memory is a high voltage to read the black block table, and S_EN provides a high voltage to enable each second switch transistor to be turned on.

In FIG. 8, the reference number TE represents a synchronization signal. The synchronization signal reflects the display frequency.

According to a specific embodiment, the display device includes a gate driving circuit, a data driving circuit, a multiplexing circuit, M columns of pixel circuits, multiple rows of gate lines and 2M columns of data lines, where M is a positive integer. A (2m−1)-th column of data line is electrically connected to pixel circuits in odd-numbered rows in an m-th column, and a 2m-th column of data line is electrically connected to pixel circuits in even-numbered rows in the m-th column, where m is a positive integer less than or equal to M. The data driving circuit includes M data voltage output terminals. The M data voltage output terminals are electrically connected to the 2M columns of data lines through the multiplexing circuit. An m-th data voltage output terminal provides corresponding data voltages to the (2m−1)-th column of data line and the 2m-th column of data line in a time-sharing manner. A display period is divided into a first display time period and a second display time period in sequence. The display control module further includes a scanning control circuit.

The scanning control circuit is configured to, in the first display time period, control the gate driving circuit to sequentially scan the odd-numbered rows of gate lines, and control the multiplexing circuit to turn on connection between the m-th data voltage output terminal and the (2m−1)-th column of data line; in the second display time period, control the gate driving circuit to sequentially scan the even-numbered rows of gate lines, and control the multiplexing circuit to turn on connection between the m-th data voltage output terminal and the 2m-th column of data line.

In actual operation, the display device may include M columns of pixel circuits and 2M columns of data lines. The odd-numbered column of data line is electrically connected to odd-numbered row of pixel circuits, and the even-numbered column of data line is electrically connected to the even-numbered row of pixel circuits. When scanning gate lines, the odd-numbered rows of gate lines may be sequentially scanned in the first display time period, and the even-numbered rows of gate lines may be sequentially scanned in the second display time period to reduce power consumption of the driver IC.

According to another specific embodiment, the display device includes a gate driving circuit, a data driving circuit, a multiplexing circuit, M columns of pixel circuits, multiple rows of gate lines and 2M columns of data lines, where M is a positive integer. A (2m−1)-th column of data line is electrically connected to pixel circuits in odd-numbered rows in an m-th column, and a 2m-th column of data line is electrically connected to pixel circuits in even-numbered rows in the m-th column, where m is a positive integer less than or equal to M. The data driving circuit includes M data voltage output terminals. The M data voltage output terminals are electrically connected to the 2M columns of data lines through the multiplexing circuit. An m-th data voltage output terminal provides corresponding data voltages to the (2m−1)-th column of data line and the 2m-th column of data line in a time-sharing manner. A display period is divided into a first display time period and a second display time period in sequence. The display control module further includes a scanning control circuit.

The scanning control circuit is configured to, in the first display time period, control the gate driving circuit to sequentially scan the even-numbered rows of gate lines, and control the multiplexing circuit to turn on connection between the m-th data voltage output terminal and the 2m-th column of data line; in the second display time period, control the gate driving circuit to sequentially scan the odd-numbered rows of gate lines, and control the multiplexing circuit to turn on connection between the m-th data voltage output terminal and the (2m−1)-th column of data line.

In actual operation, the display device may include M columns of pixel circuits and 2M columns of data lines. The odd-numbered column of data line is electrically connected to odd-numbered row of pixel circuits, and the even-numbered column of data line is electrically connected to the even-numbered row of pixel circuits. When scanning gate lines, the even-numbered rows of gate lines may be sequentially scanned in the first display time period, and the odd-numbered rows of gate lines may be sequentially scanned in the second display time period to reduce power consumption of the driver IC.

In the embodiment of the present application, when one column of pixel circuits are corresponding to two columns of data lines, an odd-numbered column of data line may be set to be electrically connected to the odd-numbered rows of pixel circuits, and an even-numbered column of data line may be set to be electrically connected to the even-numbered rows of pixel circuits. Further, when scanning the gate lines, the even-numbered rows of gate lines are scanned first, and then the odd-numbered rows of gate lines are scanned sequentially.

According to another specific embodiment, the display device includes a gate driving circuit, a data driving circuit, a multiplexing circuit, M columns of pixel circuits, multiple rows of gate lines and 2M columns of data lines, where M is a positive integer. A (2m−1)-th column of data line is electrically connected to pixel circuits in even-numbered rows in an m-th column, and a 2m-th column of data line is electrically connected to pixel circuits in odd-numbered rows in the m-th column, where m is a positive integer less than or equal to M. The data driving circuit includes M data voltage output terminals. The M data voltage output terminals are electrically connected to the 2M columns of data lines through the multiplexing circuit. An m-th data voltage output terminal provides corresponding data voltages to the (2m−1)-th column of data line and the 2m-th column of data line in a time-sharing manner. A display period is divided into a first display time period and a second display time period in sequence. The display control module further includes a scanning control circuit.

The scanning control circuit is configured to, in the first display time period, control the gate driving circuit to sequentially scan the odd-numbered rows of gate lines, and control the multiplexing circuit to turn on connection between the m-th data voltage output terminal and the 2m-th column of data line; in the second display time period, control the gate driving circuit to sequentially scan the even-numbered rows of gate lines, and control the multiplexing circuit to turn on connection between the m-th data voltage output terminal and the (2m−1)-th column of data line.

In actual operation, the display device may include M columns of pixel circuits and 2M columns of data lines. The odd-numbered column of data line is electrically connected to the even-numbered rows of pixel circuits, and the even-numbered column of data line is electrically connected to the odd-numbered rows of pixel circuits. When scanning gate lines, the odd-numbered rows of gate lines may be sequentially scanned in the first display time period, and the even-numbered rows of gate lines may be sequentially scanned in the second display time period to reduce power consumption of the driver IC.

In the embodiment of the present application, when one column of pixel circuits are corresponding to two columns of data lines, an odd-numbered column of data line may be set to be electrically connected to the even-numbered rows of pixel circuits, and an even-numbered column of data line may be set to be electrically connected to the odd-numbered rows of pixel circuits. Further, when scanning the gate lines, the odd-numbered rows of gate lines are scanned first, and then the even-numbered rows of gate lines are scanned sequentially.

According to another specific embodiment, the display device includes a gate driving circuit, a data driving circuit, a multiplexing circuit, M columns of pixel circuits, multiple rows of gate lines and 2M columns of data lines, where M is a positive integer. A (2m−1)-th column of data line is electrically connected to pixel circuits in even-numbered rows in an m-th column, and a 2m-th column of data line is electrically connected to pixel circuits in odd-numbered rows in the m-th column, where m is a positive integer less than or equal to M. The data driving circuit includes M data voltage output terminals. The M data voltage output terminals are electrically connected to the 2M columns of data lines through the multiplexing circuit. An m-th data voltage output terminal provides corresponding data voltages to the (2m−1)-th column of data line and the 2m-th column of data line in a time-sharing manner. A display period is divided into a first display time period and a second display time period in sequence. The display control module further includes a scanning control circuit.

The scanning control circuit is configured to, in the first display time period, control the gate driving circuit to sequentially scan the even-numbered rows of gate lines, and control the multiplexing circuit to turn on connection between the m-th data voltage output terminal and the (2m−1)-th column of data line; in the second display time period, control the gate driving circuit to sequentially scan the odd-numbered rows of gate lines, and control the multiplexing circuit to turn on connection between the m-th data voltage output terminal and the 2m-th column of data line.

In actual operation, the display device may include M columns of pixel circuits and 2M columns of data lines. The odd-numbered column of data line is electrically connected to the even-numbered rows of pixel circuits, and the even-numbered column of data line is electrically connected to the odd-numbered rows of pixel circuits. When scanning gate lines, the even-numbered rows of gate lines may be sequentially scanned in the first display time period, and the odd-numbered rows of gate lines may be sequentially scanned in the second display time period to reduce power consumption of the driver IC.

In the embodiment of the present application, when one column of pixel circuits are corresponding to two columns of data lines, an even-numbered column of data line may be set to be electrically connected to the odd-numbered rows of pixel circuits, and an odd-numbered column of data line may be set to be electrically connected to the even-numbered rows of pixel circuits. Further, when scanning the gate lines, the even-numbered rows of gate lines are scanned first, and then the odd-numbered rows of gate lines are scanned sequentially.

The display device according to the embodiment of the present application includes the foregoing display control module.

The display device according to the embodiment of the present application may be any product or component with a display function, such as a mobile phone, a tablet computer, a television, a monitor, a notebook computer, a digital photo frame, a navigator.

The above are merely the embodiments of the present disclosure and shall not be used to limit the scope of the present disclosure. It should be noted that, a person skilled in the art may make improvements and modifications without departing from the principle of the present disclosure, and these improvements and modifications shall also fall within the scope of the present disclosure. The protection scope of the present disclosure shall be subject to the protection scope of the claims.

What is claimed is:

1. A display control method for a display device with a display panel and a data processing circuit, comprising:

according to a to-be-displayed picture, detecting, by a black-screen area detection circuit, a black-screen display area of the display panel in an always-on mode;

controlling, by a logic control circuit, to stop providing display data corresponding to the black-screen display area, for the data processing circuit;

wherein the display data corresponding to the black-screen display area included in the to-be-displayed picture is black-screen display data, wherein the display device includes a gate driving circuit, M columns of pixel circuits, multiple rows of gate lines, and 2M columns of data lines, wherein M is a positive integer; a (2m−1)-th column of data line is electrically connected to pixel circuits in odd-numbered rows in an m-th column, and a 2m-th column of data line is electrically connected to pixel circuits in even-numbered rows in the m-th column, wherein m is a positive integer less than or equal to M; the display control method includes:

dividing a display period into a first display time period and a second display time period in sequence;

in the first display time period, controlling the gate driving circuit to sequentially scan odd-numbered rows of gate lines, and controlling the (2m−1)-th column of data line to provide a corresponding data voltage for the pixel circuits in the odd-numbered rows in the m-th column;

in the second display time period, controlling the gate driving circuit to sequentially scan even-numbered rows of gate lines, and controlling the 2m-th column of data line to provide a corresponding data voltage for the pixel circuits in the even-numbered rows in the m-th column;

or, wherein the display device includes a gate driving circuit, M columns of pixel circuits, multiple rows of gate lines, and 2M columns of data lines, wherein M is a positive integer; a (2m−1)-th column of data line is electrically connected to pixel circuits in even-numbered rows in an m-th column, an 2m-th column of data line is electrically connected to pixel circuits in odd-numbered rows in the m-th column, wherein m is a positive integer less than or equal to M; the display control method includes:

dividing a display period into a first display time period and a second display time period in sequence;

in the first display time period, controlling the gate driving circuit to sequentially scan odd-numbered rows of gate lines, and controlling the 2m-th column of data line to provide a corresponding data voltage for the pixel circuits in the odd-numbered rows in the m-th column;

in the second display time period, controlling the gate driving circuit to sequentially scan even-numbered rows of gate lines, and controlling the (2m−1)-th column of data line to provide a corresponding data voltage for the pixel circuits in the even-numbered rows in the m-th column;

or, wherein the display device includes a gate driving circuit, M columns of pixel circuits, multiple rows of gate lines, and 2M columns of data lines, wherein M is a positive integer; a (2m−1)-th column of data line is electrically connected to pixel circuits in odd-numbered rows in an m-th column, and a 2m-th column of data line is electrically connected to pixel circuits in even-numbered rows in the m-th column, wherein m is a positive integer less than or equal to M; the display control method includes:

dividing a display period into a first display time period and a second display time period in sequence;

in the first display time period, controlling the gate driving circuit to sequentially scan even-numbered rows of gate lines, and controlling the 2m-th column of data line to provide a corresponding data voltage for the pixel circuits in the even-numbered rows in the m-th column;

in the second display time period, controlling the gate driving circuit to sequentially scan odd-numbered rows of gate lines, and controlling the (2m−1)-th column of data line to provide a corresponding data voltage for the pixel circuits in the odd-numbered rows in the m-th column;

or, wherein the display device includes a gate driving circuit, M columns of pixel circuits, multiple rows of gate lines, and 2M columns of data lines, wherein M is a positive integer; a (2m−1)-th column of data line is electrically connected to pixel circuits in even-numbered rows in an m-th column, an 2m-th column of data line is electrically connected to pixel circuits in odd-numbered rows in the m-th column, wherein m is a positive integer less than or equal to M; the display control method includes:

dividing a display period into a first display time period and a second display time period in sequence;

in the first display time period, controlling the gate driving circuit to sequentially scan even-numbered rows of gate lines, and controlling the (2m−1)-th column of data line to provide a corresponding data voltage for the pixel circuits in the even-numbered rows in the m-th column;

in the second display time period, controlling the gate driving circuit to sequentially scan odd-numbered rows of gate lines, and controlling the 2m-th column of data line to provide a corresponding data voltage for the pixel circuits in the odd-numbered rows in the m-th column.

2. The display control method according to claim 1, further comprising:

when the display panel is in the always-on mode, controlling, by the logic control circuit, a data voltage control circuit to provide a black-screen data voltage to a data line corresponding to the black-screen display area when a row of gate line corresponding to the black-screen display area is turned on.

3. The display control method according to claim 1, wherein the display device further includes a data driving circuit; the display control method further includes:

when the display panel is in the always-on mode, controlling, by the logic control circuit, the data driving circuit to provide a data voltage for displaying to a data line corresponding to a normal display area when a row of gate line corresponding to the normal display area is turned on;

wherein the normal display area is an area included in a display area of the display panel except for the black-screen display area.

4. The display control method according to claim 1, wherein according to the to-be-displayed picture, detecting, by the black-screen area detection circuit, the black-screen display area of the display panel in the always-on mode, includes:

dividing a display area of the display panel into multiple rows and multiple columns of grid display areas;

receiving, by the black-screen area detection circuit, the to-be-displayed picture, and, judging one grid display area as the black-seen display area when detecting that the to-be-displayed picture is a completely black screen in the one grid display area.

5. The display control method according to claim 1, wherein the method further includes: when the display panel is in the always-on mode, in a first display time period included in a predetermined display period, controlling a frequency of a gate driving signal on an odd-numbered row of gate line to be less than or equal to a first predetermined frequency; and, in a second display time period included in the predetermined display period, controlling a frequency of a gate driving signal on an even-numbered row of gate line to be less than or equal to the first predetermined frequency;

wherein the predetermined display period is a display period other than a first display period after a screen is switched.

6. The display control method according to claim 1, wherein the method further includes: when the display panel is in the always-on mode, in a first display time period included in a first display period after a screen is switched, controlling a frequency of a gate driving signal on an odd-numbered row of gate line to be greater than or equal to a second predetermined frequency; and, in a second display time period included in the first display period after the screen is switched, controlling a frequency of a gate driving signal on an even-numbered row of gate line to be greater than or equal to the second predetermined frequency.

7. The display control method according to claim 1, wherein the method further includes: when the display panel is in the always-on mode, in a first display time period included in a predetermined display period, controlling a frequency of a gate driving signal on an even-numbered row of gate line to be less than or equal to a first predetermined frequency; and, in a second display time period included in the predetermined display period, controlling a frequency of a gate driving signal on an odd-numbered row of gate line to be less than or equal to the first predetermined frequency;

wherein the predetermined display period is a display period other than a first display period after a screen is switched.

8. The display control method according to claim 1, wherein the method further includes: when the display panel is in the always-on mode, in a first display time period included in a first display period after a screen is switched, controlling a frequency of a gate driving signal on an even-numbered row of gate line to be greater than or equal to a second predetermined frequency; and, in a second display time period included in the first display period after the screen is switched, controlling a frequency of a gate driving signal on an odd-numbered row of gate line to be greater than or equal to the second predetermined frequency.

9. A display control module for a display device with a display panel, a data processing circuit and a memory storing display data corresponding to a to-be-displayed picture, comprising:

a black-screen area detection circuit configured to, when the display panel is in an always-on mode, detect a black-screen display area of the display panel, according to the to-be-displayed picture; and a logic control circuit configured to, when the display panel is in the always-on mode, control the memory to stop providing display data corresponding to the black-screen display area, for the data processing circuit;

wherein the display data corresponding to the black-screen display area included in the to-be-displayed picture is black-screen display data, wherein the display device includes a gate driving circuit, a data driving circuit, a multiplexing circuit, M columns of pixel circuits, multiple rows of gate lines and 2M columns of data lines, wherein M is a positive integer; a (2m−1)-th column of data line is electrically connected to pixel circuits in odd-numbered rows in an m-th column, and a 2m-th column of data line is electrically connected to pixel circuits in even-numbered rows in the m-th column, wherein m is a positive integer less than or equal to M; the data driving circuit includes M data voltage output terminals; the M data voltage output terminals are electrically connected to the 2M columns of data lines through the multiplexing circuit, an m-th data voltage output terminal provides corresponding data voltages to the (2m−1)-th column of data line and the 2m-th column of data line in a time-sharing manner; a display period is divided into a first display time period and a second display time period in sequence; the display control module further includes a scanning control circuit;

the scanning control circuit is configured to, in the first display time period, control the gate driving circuit to sequentially scan odd-numbered rows of gate lines, and control the multiplexing circuit to turn on connection between the m-th data voltage output terminal and the (2m−1)-th column of data line; in the second display time period, control the gate driving circuit to sequentially scan the even-numbered rows of gate lines, and control the multiplexing circuit to turn on connection between the m-th data voltage output terminal and the 2m-th column of data line, or, wherein the display device includes a gate driving circuit, a data driving circuit, a multiplexing circuit, M columns of pixel circuits, multiple rows of gate lines and 2M columns of data lines, wherein M is a positive integer; a (2m−1)-th column of data line is electrically connected to pixel circuits in odd-numbered rows in an m-th column, and a 2m-th column of data line is electrically connected to pixel circuits in even-numbered rows in the m-th column, wherein m is a positive integer less than or equal to M; the data driving circuit includes M data voltage output terminals; the M data voltage output terminals are electrically connected to the 2M columns of data lines through the multiplexing circuit; an m-th data voltage output terminal provides corresponding data voltages to the (2m−1)-th column of data line and the 2m-th column of data line in a time-sharing manner; a display period is divided into a first display time period and a second display time period in sequence; the display control module further includes a scanning control circuit;

the scanning control circuit is configured to, in the first display time period, control the gate driving circuit to sequentially scan even-numbered rows of gate lines, and control the multiplexing circuit to turn on connection between the m-th data voltage output terminal and the 2m-th column of data line; in the second display time period, control the gate driving circuit to sequentially scan the odd-numbered rows of gate lines, and control the multiplexing circuit to turn on connection between the m-th data voltage output terminal and the (2m−1)-th column of data line, or wherein the display device includes a gate driving circuit, a data driving circuit, a multiplexing circuit, M columns of pixel circuits, multiple rows of gate lines and 2M columns of data lines, wherein M is a positive integer; a (2m−1)-th column of data line is electrically connected to pixel circuits in even-numbered rows in an m-th column, and a 2m-th column of data line is electrically connected to pixel circuits in odd-numbered rows in the m-th column, wherein m is a positive integer less than or equal to M; the data driving circuit includes M data voltage output terminals; the M data voltage output terminals are electrically connected to the 2M columns of data lines through the multiplexing circuit an m-th data voltage output terminal provides corresponding data voltages to the (2m−1)-th column of data line and the 2m-th column of data line in a time-sharing manner; a display period is divided into a first display time period and a second display time period in sequence; the display control module further includes a scanning control circuit;

the scanning control circuit is configured to, in the first display time period, control the gate driving circuit to sequentially scan odd-numbered rows of gate lines, and control the multiplexing circuit to turn on connection between the m-th data voltage output terminal and the 2m-th column of data line; in the second display time period, control the gate driving circuit to sequentially scan the even-numbered rows of gate lines, and control the multiplexing circuit to turn on connection between the m-th data voltage output terminal and the (2m−1)-th column of data line, or wherein the display device includes a gate driving circuit, a data driving circuit, a multiplexing circuit, M columns of pixel circuits, multiple rows of gate lines and 2M columns of data lines, wherein M is a positive integer; a (2m−1)-th column of data line is electrically connected to pixel circuits in even-numbered rows in an m-th column, and a 2m-th column of data line is electrically connected to pixel circuits in odd-numbered rows in the m-th column, wherein m is a positive integer less than or equal to M; the data driving circuit includes M data voltage output terminals; the M data voltage output terminals are electrically connected to the 2M columns of data lines through the multiplexing circuit; an m-th data voltage output terminal provides corresponding data voltages to the (2m−1)-th column of data line and the 2m-th column of data line in a time-sharing manner; a display period is divided into a first display time period and a second display time period in sequence; the display control module further includes a scanning control circuit;

the scanning control circuit is configured to, in the first display time period, control the gate driving circuit to sequentially scan even-numbered rows of gate lines, and control the multiplexing circuit to turn on connection between the m-th data voltage output terminal and the (2m−1)-th column of data line; in the second display time period, control the gate driving circuit to sequentially scan the odd-numbered rows of gate lines, and control the multiplexing circuit to turn on connection between the m-th data voltage output terminal and the 2m-th column of data line.

10. The display control module according to claim 9, wherein the display control module further includes a data voltage control circuit;

the logic control circuit is further configured to, when the display panel is in the always-on mode, control the data voltage control circuit to provide a black-screen data voltage to a data line corresponding to the black-screen display area when a row of gate line corresponding to the black-screen display area is turned on.

11. The display control module according to claim 10, wherein the display control module further includes a data driving circuit;

the logic control circuit is further configured to, when the display panel is in the always-on mode, control the data driving circuit to provide a data voltage for displaying to a data line corresponding to a normal display area when a row of gate line corresponding to the normal display area is turned on;

wherein the normal display area is an area included in a display area of the display panel except for the black-screen display area.

12. The display control module according to claim 11, wherein the data driving circuit includes M data voltage output terminals, wherein M is a positive integer;

the data voltage control circuit includes M first-switch-transistors and M second-switch-transistors;

a control electrode of an m-th first-switch-transistor is electrically connected to the logic control circuit; a first electrode of the m-th first-switch-transistor is electrically connected to an m-th data voltage output terminal; a second electrode of the m-th first-switch-transistor is electrically connected to a black-screen data voltage terminal; the black-screen data voltage terminal is configured to provide a black-screen data voltage;

a control electrode of an m-th second-switch-transistor is electrically connected to the logic control circuit; a first electrode of the m-th second-switch-transistor is electrically connected to the m-th data voltage output terminal; a second electrode of the m-th second-switch-transistor is electrically connected to a corresponding column of data line;

wherein m is a positive integer less than or equal to M;

the logic control circuit is configured to, according to the black-screen area and the normal display area, provide an m-th first-switch-control-signal to the control electrode of the m-th first-switch-transistor, thereby controlling the m-th first-switch-transistor to turn on and off; and provide an m-th second-switch-control-signal to the control electrode of the m-th second-switch-transistor, thereby controlling the m-th second-switch-transistor to turn on and off.

13. The display control module according to claim 9, wherein a display area of the display panel is divided into multiple rows and multiple columns of grid display areas; the black-screen area detection circuit is configured to receive the to-be-displayed picture, and, judge one grid display area as the black-seen display area when detecting that the to-be-displayed picture is a completely black screen in the one grid display area.

14. A display device, comprising: a display panel, a memory, a data processing circuit and a display control module according to claim 9;

wherein the memory stores display data corresponding to a to-be-displayed picture.

15. A display control module for a display device with a display panel, a data processing circuit and a memory storing display data corresponding to a to-be-displayed picture, comprising:

a black-screen area detection circuit configured to, when the display panel is in an always-on mode, detect a black-screen display area of the display panel, according to the to-be-displayed picture; and a logic control circuit configured to, when the display panel is in the always-on mode, control the memory to stop providing display data corresponding to the black-screen display area, for the data processing circuit;

wherein the display data corresponding to the black-screen display area included in the to-be-displayed picture is black-screen display data, wherein the display control module further includes a data voltage control circuit;

the logic control circuit is further configured to, when the display panel is in the always-on mode, control the data voltage control circuit to provide a black-screen data voltage to a data line corresponding to the black-screen display area when a row of gate line corresponding to the black-screen display area is turned on, wherein the display control module further includes a data driving circuit;

the logic control circuit is further configured to, when the display panel is in the always-on mode, control the data driving circuit to provide a data voltage for displaying to a data line corresponding to a normal display area when a row of gate line corresponding to the normal display area is turned on;

wherein the normal display area is an area included in a display area of the display panel except for the black-screen display area, wherein the data driving circuit includes M data voltage output terminals, wherein M is a positive integer;

the data voltage control circuit includes M first-switch-transistors and M second-switch-transistors;

a control electrode of an m-th first-switch-transistor is electrically connected to the logic control circuit; a first electrode of the m-th first-switch-transistor is electrically connected to an m-th data voltage output terminal; a second electrode of the m-th first-switch-transistor is electrically connected to a black-screen data voltage terminal; the black-screen data voltage terminal is configured to provide a black-screen data voltage;

a control electrode of an m-th second-switch-transistor is electrically connected to the logic control circuit; a first electrode of the m-th second-switch-transistor is electrically connected to the m-th data voltage output terminal; a second electrode of the m-th second-switch-transistor is electrically connected to a corresponding column of data line;

wherein m is a positive integer less than or equal to M;

the logic control circuit is configured to, according to the black-screen area and the normal display area, provide an m-th first-switch-control-signal to the control electrode of the m-th first-switch-transistor, thereby controlling the m-th first-switch-transistor to turn on and off; and provide an m-th second-switch-control-signal to the control electrode of the m-th second-switch-transistor, thereby controlling the m-th second-switch-transistor to turn on and off.

* * * * *